US010648331B2

(12) United States Patent
Hall et al.

(10) Patent No.: US 10,648,331 B2
(45) Date of Patent: May 12, 2020

(54) METHOD OF STRIP MINING

(71) Applicant: OPTI-MINEZ PTY LTD, Bulimba, Brisbane, Queensland (AU)

(72) Inventors: David Hall, Brisbane (AU); Ted Boulton, Brisbane (AU); Lachlan Yeldham, Brisbane (AU)

(73) Assignee: OPTI-MINEZ PTY LTD, Brisbane, Queensland (AU)

( * ) Notice: Subject to any disclaimer, the term of this patent is extended or adjusted under 35 U.S.C. 154(b) by 0 days.

(21) Appl. No.: 16/329,003

(22) PCT Filed: Aug. 29, 2017

(86) PCT No.: PCT/AU2017/050915
§ 371 (c)(1),
(2) Date: Feb. 27, 2019

(87) PCT Pub. No.: WO2018/039709
PCT Pub. Date: Mar. 8, 2018

(65) Prior Publication Data

US 2019/0203596 A1 Jul. 4, 2019

(30) Foreign Application Priority Data

Aug. 29, 2016 (AU) ..... 2016903427

(51) Int. Cl.
*E21C 41/00* (2006.01)
*E21C 41/26* (2006.01)
*E02F 3/48* (2006.01)

(52) U.S. Cl.
CPC ..... *E21C 41/26* (2013.01); *E02F 3/48* (2013.01)

(58) Field of Classification Search
CPC ..... E21C 41/00; E21C 41/26; E21C 41/28
(Continued)

(56) References Cited

U.S. PATENT DOCUMENTS 1,684,147 A 9/1928 Roberts
4,290,651 A * 9/1981 Files ..... E21C 41/26 299/18

(Continued)

FOREIGN PATENT DOCUMENTS

WO 2007076571 A1 7/2007

OTHER PUBLICATIONS

International Search Report dated Nov. 21, 2017 in Application No. PCT/AU2017/050915, pp. 1-5.

(Continued)

*Primary Examiner* — Sunil Singh
(74) *Attorney, Agent, or Firm* — Wegman Hessler

(57) ABSTRACT

A method of moving waste material from a mining site using at least one excavator and a plurality of dozers, including excavating material with the at least one excavator from a dig area, said at least one excavator moving along an excavator path that is parallel with the dig area, transferring the excavated material to a plurality of slots, each of said slots are positioned at an angle to the excavator path, and pushing the transferred material by one of said plurality of dozers along the slot and away from the excavator path; wherein each slot allows each of the plurality of dozers to move between a proximal position and a distal position relative to the excavator path.

16 Claims, 14 Drawing Sheets

(58) Field of Classification Search
USPC ..... 299/18, 19
See application file for complete search history.

(56) References Cited

U.S. PATENT DOCUMENTS

| | | | | |
|---|---|---|---|---|
| 4,589,700 | A * | 5/1986 | Schroder | E21C 41/26 299/18 |
| 2010/0171360 | A1 | 7/2010 | Drummond et al. | |
| 2015/0252671 | A1 | 9/2015 | MacDonald | |

OTHER PUBLICATIONS

International Preliminary Report on Patentability dated Sep. 11, 2018 in Application No. PCT/AU2017/050915, pp. 1-4.
Written Opinion dated Nov. 21, 2017 in Application No. PCT/AU2017/050915, pp. 1-5.
Written Opinion dated Jul. 30, 2018 in Application No. PCT/AU2017/050915, pp. 1-5.

* cited by examiner

| | CDX | | | | | Post Dozing | | | | |
|---|---|---|---|---|---|---|---|---|---|---|
| | Prime Material Moved (tcm) | Total Material Moved (tcm) | Movement % of Prime | Total Cost | Cost per Total tcm | Prime Material Moved (bcm) | Total Material Moved (bcm) | Movement % of Prime | Total Cost | Cost per Total bcm |
| Cast Blasting | 437,500 | 437,500 | 25% | $ 1,750,000 | $ 1.00 | 437,500 | 437,500 | 25% | $ 1,750,000 | $ 1.00 |
| First Bulk Doze | 927,500 | 927,500 | 53% | $ 2,244,550 | $ 2.42 | 783,009 | 783,009 | 45% | $ 1,691,299 | $ 2.16 |
| Truck/Excavator | 385,000 | 385,000 | 22% | $ 1,347,500 | $ 3.50 | | | | | |
| Excavator Only | | | | | | 73,231 | 592,244 | 34% | $ 414,571 | $ 0.70 |
| Second Bulk Doze | | | | | | 456,260 | 466,737 | 27% | $ 956,811 | $ 2.05 |
| Total | 1,750,000 | | 100% | $ 5,342,050 | $ 3.05 | 1,750,000 | 2,279,490 | 130% | $ 4,812,681 | $ 2.75 |

Fig. 30

| | CDX | | | | | Post Dozing | | | | |
|---|---|---|---|---|---|---|---|---|---|---|
| | Prime Material Moved (bcm) | Total Material Moved (bcm) | Movement % of Prime | Total Cost | Cost per Total bcm | Prime Material Moved (bcm) | Total Material Moved (bcm) | Movement % of Prime | Total Cost | Cost per Total bcm |
| Cast Blasting | 120,000 | 120,000 | 10% | $ 1,250,000 | $ 1.00 | 120,000 | 120,000 | 10% | $ 1,250,000 | $ 1.00 |
| First Bulk Doze | 630,000 | 630,000 | 50% | $ 674,100 | $ 1.07 | 630,000 | 630,000 | 50% | $ 674,100 | $ 1.07 |
| Truck/Excavator | 500,000 | 797,000 | 64% | $ 2,788,500 | $ 3.50 | | | | | |
| Excavator Only | | | | | | 73,231 | 908,847 | 73% | $ 634,793 | $ 0.70 |
| Second Bulk Doze | | | | | | 436,769 | 796,146 | 64% | $ 1,612,099 | $ 2.03 |
| Total | 1,250,000 | 1,547,000 | 124% | $ 4,713,600 | $ 3.77 | 1,250,000 | 2,452,992 | 196% | $ 4,198,992 | $ 3.36 |

METHOD OF STRIP MINING

CROSS-REFERENCE TO RELATED APPLICATION

This application is a national phase of International Patent Application No. PCT/AU2017/050915 filed Aug. 29, 2017 and which claims the priority filing benefit of Australian Patent Application No. 2016903427 filed Aug. 29, 2016, which are incorporated herein by reference in their entirety.

FIELD OF INVENTION

The present invention relates to moving earth including dirt, rock and like material using dozers, scrapers, high grade tolerant trucks, and slushers and in particular where there is insufficient spoil room for the equipment to remove all of the material. The present invention has particular but not exclusive application in moving earth in mining operations. Reference to mining operations is by way of example only and the invention is not limited to mining operations. Furthermore the specification refers to the use of dozers but the invention also applies to other similar earth moving equipment.

BACKGROUND OF THE INVENTION

Strip mining is a method of removing the waste rock from above the ore body in strips to expose the ore to be mined and depositing the waste rock in the void of the previously mined strip. The strip mining method usually starts with a box cut, which removes the waste rock from above the ore body to another location. The ore is mined and the miners move to another strip. With the new strip the waste rock is deposited in the void created from the previously mined strip. The method is repeated as the mining operation continues to advance.

The amount of material from a particular strip that can be moved by dragline or bulk doze methods is limited by the spoil room available in the previous strip void in which to deposit the material. Truck shovel is a more expensive method, however it is not limited by spoil room in the previous void as the truck can haul the material out of the excavation to an alternate dump location.

The conventional strip mining method uses a series of steps of uncovering the seam of coal using cast blasting, bulk dozer push and truck/excavator stripping. This is shown in the FIGS. 1-4.

With reference to FIG. 1, a seam of coal 1 is overlain by a waste burden 2 that is several times the thickness of the coal 1. The direction of stripping advance is to the right in the section.

In FIG. 2, a strip of waste is blasted and some material is thrown by the blast into a position 3 where it is considered to be in final spoil because it does not have to be moved further in order to uncover and mine the coal. Position 3 is in the void 6 from the previous strip, which is adjacent to the spoil 7 from the previous strip.

The dozers 14 then push waste material across the low wall batter line 4 into final spoil (see FIG. 3). The productivity of the dozer 14 declines as the uphill angle and distance of the push increases. As the productivity of the dozer 14 declines, the unit cost of moving waste material with the dozer increases proportionately. The lowest overall cost outcome is obtained when the dozer 14 ceases pushing material when the cost of pushing material is equivalent to the cost of using an excavator 16 and truck 5 to remove the material. Area 7 indicates the material that is moved by the dozer 14. The remainder of the waste material is then moved by an excavator 16 and trucks 5.

As shown in FIG. 4, an excavator 16 digs out the remaining waste, placing it into trucks 5 which haul the material to a waste dump. The excavator and truck fleet is supported by a dozer to clean up the dig face, a dozer to maintain the waste dump, a grader to maintain the road surface and a water truck to suppress dust on the haul road. Due to the large number of machines involved and the relatively long material movement distance, stripping with an excavator and trucks is typically more expensive per unit of material moved than stripping by a dozer.

The commercial viability of mining a particular site depends on the cost of removing the waste material to provide access to the ore layer. The need to employ more expensive methods and equipment of removing waste material lowers the commercial viability of the mining operation.

OBJECT OF THE INVENTION

It is an object of the present invention to provide an alternate method of moving earth using a dozer that overcomes at least in part one or more of the disadvantages mentioned above.

SUMMARY OF THE INVENTION

The problem addressed by the inventors was to reduce the cost of moving waste material. The inventors developed a method in a series of steps and solving the problem encountered at each of the steps.

The amount of waste that must be removed in each strip to uncover the ore or coal (strip ratio) is in the order of 5 to 20 times the amount of ore or coal. The cost of moving the waste is multiplied by the strip ratio to give the cost of producing a tonne of product. Thus even a modest decrease in waste movement cost can deliver significant benefits to the profitability of a mine.

In a first step, the inventors made a number of observations. The inventors identified that the truck/excavator combination was the most expensive method for moving waste. The majority of the cost associated with truck/excavator combination was incurred by the trucks and ancillary machines, while the excavator on their own were relatively inexpensive per cubic metre of production. The excavator by themselves can pick up and dump material cheaper than a dozer, but its limited reach allowed the waste material to be moved only a short distance. The excavators do not create any new in-pit spoil room. Dozers are cheaper than the truck/excavator combinations but their application is limited by in-pit spoil room as they push material away at a shallow uphill angle which limits the in-pit spoil room available to the dozer.

The inventors, in light of these observations, developed alternatives that reduced the amount of use of the truck/excavator combination and increased the amount of dozer usage. They developed a method whereby an excavator can lift material up and a dozer can push it away to final spoil. Because the excavator is lifting material up to a higher level than the dozers could otherwise achieve on their own, more spoil room is created for the dozer, and thereby extending the application of the dozers to move a greater proportion of the waste material. It was determined that the combination of the excavator and doze was comparatively cheaper to use than the truck and excavator combination when a low cost per cubic metre excavator was used and the capacity of the dozers and excavator were appropriately matched.

The inventors identified a problem with this alternative method. The problem was matching the dozer and excavator capacities. To match the large low cost per cubic metre excavators, the inventors determined that it would require two or more dozers working continuously with the excavator. However, it was only possible to use one dozer at a time with the excavator because the dozers were running up and down the same push line within a single slot because the excavator could not reach far enough to place material in the second slot. Using two or more dozers simultaneously in the one slot would result in delays and potentially collisions.

The inventors considered running a large excavator part time so that it was matched to one dozer. However the fixed costs of owning the excavator rises and it makes the operation no more cost effective than truck/excavator combination. They also considered using a smaller excavator that was matched to the use of one dozer. However, the excavator would be too small to reach enough material below the bench and the small excavator would have a high operating cost per cubic metre, making the operation uncompetitive with the truck/excavator combination. A large excavator must be used, but it requires two or more dozers working simultaneously with the excavator in order for this method to be economic.

In order to use multiple dozers simultaneously with the excavator, the inventors in a second step changed the angle of the excavator face so that it intersects several dozer slots.

Mining excavators have a limitation on the maximum working grade that the machine can operate on. Initially, it was planned to operate the excavator on the dozer push floor, however the dozers work to grades that are in excess of the maximum working grade for the excavator. To limit the dozer grade to the maximum working grade of the excavator would have decreased the available spoil room and made the method uncompetitive with truck shovel. In a third step, the problem was solved by inclining the excavator bench at a lower grade than the dozer bench and the height of the excavator bench and the dozer bench diverge as you traverse from high wall to low wall side. The excavator digs material from below its tracks and dumps it on the dozer final grade which is above the level of the tracks.

In a fourth step, the inventors considered the option of maximising the use of the large excavator. The excavator bench height was set to the maximum dig depth achievable by the excavator to maximise the amount material taken by the excavator, because any remaining material not taken by the excavator must be removed by the more expensive truck/excavator method. When maximising the material taken by a large excavator, the dozers started to run out of spoil room that is within an economic push distance as the last of the material is pushed to spoil. To solve this problem, the final pushes are realigned and pushed at a different angle to the early pushes, which enables the dozer to push material at the same grade yet stockpile it higher, creating the required additional spoil room.

Then the excavator directly spoils remaining material against the low wall, stacking it up to maximum dump height which is several metres above the level of the excavator, creating more additional spoil room at low cost.

The large mining excavators are very large machines and have the potential to endanger life and property if the bucket were to come into contact with a dozer. It was envisaged that the excavator would traverse the bench approximately each hour. This opened the possibility of collisions. To solve this problem, the inventors developed an operational sequence where the dozers follow the excavator as it works from high wall to low wall and the dozers never enter the swing radius of the excavator. With this option in mind, the bench grades and levels were determined so that the excavator and dozer have visual contact at all times and the size of the stockpile was limited so that it does not obscure line of sight between the machines.

In order to develop the method a large amount of trial and experimentation was carried out. The trial and experimentation involved computer modelling and reduced scale versions of mining operations.

In one aspect the present invention broadly resides in a method of moving waste material from a mining site using at least one excavator and a plurality of dozers, including excavating material with the at least one excavator from a dig area, said at least one excavator moving along an excavator path that is parallel with the dig area;

transferring the excavated material to a plurality of slots, each of said slots are positioned at an angle to the excavator path; and pushing the transferred material by one of said plurality of dozers along the slot and away from the excavator path; wherein each slot allows each of the plurality of dozers to move between a proximal position and a distal position relative to the excavator path.

Preferably the excavator path is bordered by a high wall of the dig area and a low wall adjacent the slots. The excavator path can be wide to form an excavator bench. Preferably the excavator bench is higher near the low wall compared to the excavator bench section adjacent the high wall.

Preferably each slot is wide enough for one of said dozers to move along its length.

Preferably the excavator deposits the transferred material part way along each of the slots so that the dozers can move to the low wall end of the adjacent slot and then move forward to push the transferred material.

Preferably the method avoids the need for each of the dozers to turn around thereby minimizing delays associated with turning around.

Preferably the slots are adjacent and parallel with each other.

Preferably the angle between the slots and the excavator path is between 10 and 80 degrees and more preferably substantially 45 degrees.

Preferably the height difference between a level of the slot and a level of the excavator path is up to 10 meters. Preferably the height difference between the slot level and the excavator path level does not exceed the capacity of the excavator to dig material and transfer it to the slot level.

Preferably the final pushes are realigned and pushed at a different angle to the early pushes, which enables the dozer to push material at the same grade yet stockpile it higher.

Preferably the dozers follow the excavator as it works from the high wall to the low wall. Preferably the dozers never enter the swing radius of the excavator.

Preferably the bench grades and levels are determined so that the excavator and dozer have visual contact at all times. Preferably the size of the transferred material is limited so that it does not obscure the line of sight between the machines. More preferably the height of the transferred material is limited so that it does not obscure the line of sight between the machines.

In a particular embodiment the material can be blasted prior to application of the method. Preferably the blasting is arranged so that some of the waste material is diverted to the spoil area.

Where blasting has been employed (as well as other suitable situations), the dozers are preferably used to move the waste material until the grade becomes too steep that it is commercially not economical to continue. In these situations, it is preferable that the new method involving the dozers and the excavator is employed.

The new method (hereinafter referred to as post dozing) involves replacing expensive truck shovel material movement with cheaper dozer push material movement by increasing the spoil room in which to spoil dozer push material. An excavator is used to elevate the lower material to a higher level where the dozers can push it economically to spoil. Additional spoil room is achieved by setting the final dozer floor at a higher level than would be the case in a conventional cast/doze/excavate operation. The higher final dozer floor increases the economic push distance and creates further additional spoil room through longer pushes. The excavator swings material from the high wall side to the low wall side, decreasing the distance of the material from its final spoil location and increasing the productivity of the dozer to push this material to spoil.

The post dozing method is demonstrated in the following sequence using the same geometry as in the example of the conventional method in FIGS. 5 to 8.

A blast casts a portion of the material into final spoil.

The dozers push the upper blasted waste material to spoil. The final surface for the dozers is higher than would be the case in a conventional dozer push operation. Less dozer material is taken in this phase of the operation compared to a convention dozer push. The dozer push distances and elevations in post dozing are reduced compared to a conventional dozer push which leads to an increase in the average dozer push productivity for this material.

After the dozers have moved all of the material above the final dozer profile, the excavator commences side-casting material from below the final dozer profile up onto the final dozer profile. The dozer pushes this material away to the final spoil.

The excavator then takes the material that sits within its swing radius of the low wall and casts it directly to the final spoil. Any material that is left below the reach of the excavator can either be rehandled up by the excavator on the next pass and either dozed to spoil or cast to spoil by the excavator.

If the waste material remains in the pit below the reach of the excavator from the excavator bench, this material can be removed by using trucks as part of the post dozing method. Material that is left below the excavator bench may be dozed along the strip to an area where the coal has been mined such that it is placed in final spoil and does not have to be moved again to uncover coal.

The excavator bench may consist of more than one level and material can be dug from the lowest level and placed on the upmost level and then rehandled onto the final dozer profile to be pushed to final spoil by a dozer.

The final dozer profile angle can be increased in order to fit additional dozer material into spoil. The higher angle pushes would be undertaken by the dozer at the completion of the cut adjacent to the excavator bench. The higher angle pushes would be shorter than the earlier lower angle pushes so as to not cause the cost of moving the waste to rise above the comparative cost of moving the material using truck/shovel. The higher angle pushes may be made at an angle away from perpendicular to the high wall so that the apparent grade for the dozer is less than if the material is pushed perpendicular to the high wall.

The dozers may be used to push the excavator side cast spoil away from the edge of the low wall to enable the excavator to spoil further material on the low wall.

The features described with respect to one aspect also apply where applicable to all other aspects of the invention. Furthermore different combinations of described features are herein described and claimed even when not expressly stated.

BRIEF DESCRIPTION OF THE DRAWINGS

In order that the present invention can be more readily understood reference will now be made to the accompanying drawings which illustrate a preferred embodiment of the invention and wherein:

FIG. 30 is a table showing the cost comparison of CDX and post dozing method for waste removal costs in Pit B for one whole waste strip.

DETAILED DESCRIPTION OF THE PREFERRED EMBODIMENT

Prior to the invention, the use of an excavator to cast material to a dozer would have incurred the following problems which would have had the effect of making the use of an excavator to support dozers less safe, less cost effective and hence less attractive.

The dozer must pass within the swing radius of the excavator when pushing material that has been cast up by the excavator to spoil. This presents a safety hazard, slowing down the operation and limiting the amount of material that can be taken by the excavator and the production rate for that material.

A medium to large sized excavator must be used in order to have sufficient reach to make the method commercially feasible. However, with medium to large excavator, more than one dozer is required to keep up. Using more than one dozer simultaneously would mean that multiple dozers have to use the same slot, creating a safety hazard and incurring delays which would make the method unproductive.

The invention solves the problems of safety and productivity using the following geometry and sequence.

Dozers 14 work ahead of the post dozing operation, pushing material to final spoil down to a predetermined post dozing design surface 9. The post dozing surface is calculated either by method of cross sections or in 3D by raising the pivot point until the material within the reach of the excavator below the excavator bench 20 will fit into the dozer final spoil volume 28 while filling out to the dozer economic push distance and grade limits, thus maximising the initial conventional dozer volume 8 and the amount of economic post doze material.

Figure 1:
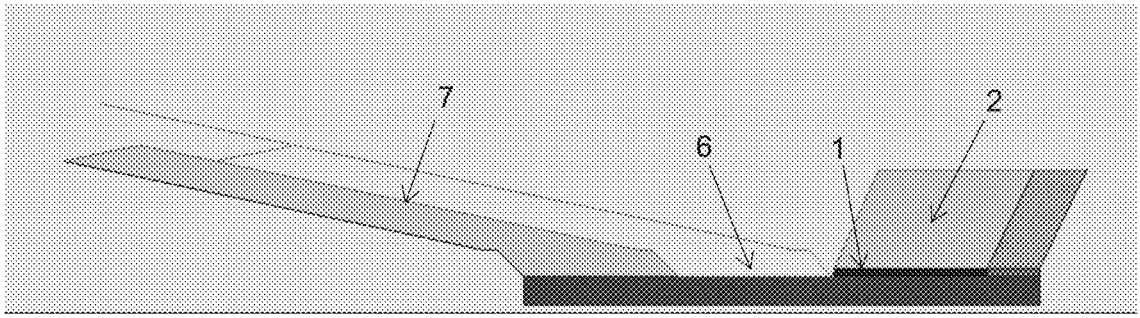
FIGS. 1 to 4 are a series of diagrammatic figures showing sequential steps in the conventional strip mining method.
Figure 2:
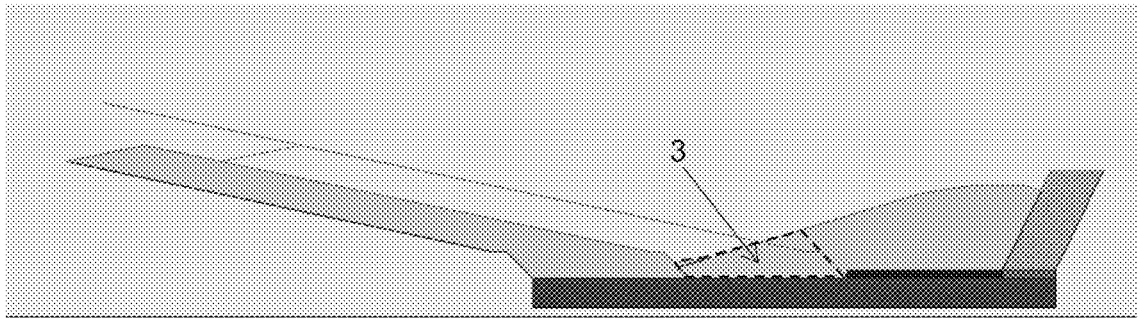
Figure 3:
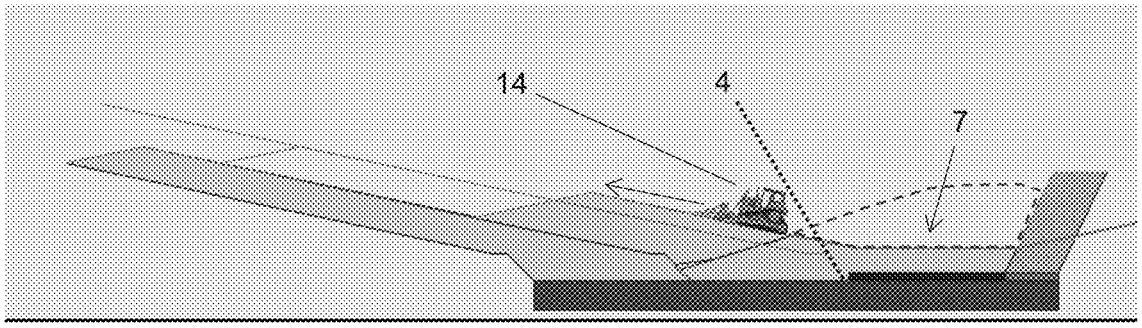
Figure 4:
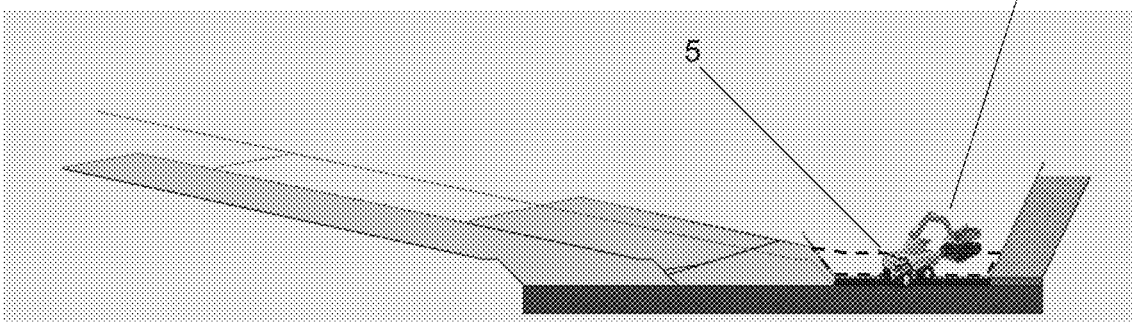
Figure 5:
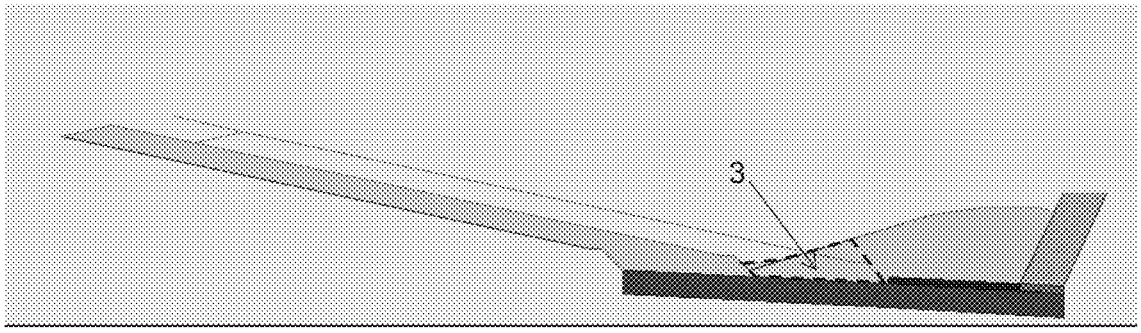
FIGS. 5 to 8 are a series of diagrammatic figures showing sequential steps in the new post dozing mining method.
Figure 6:
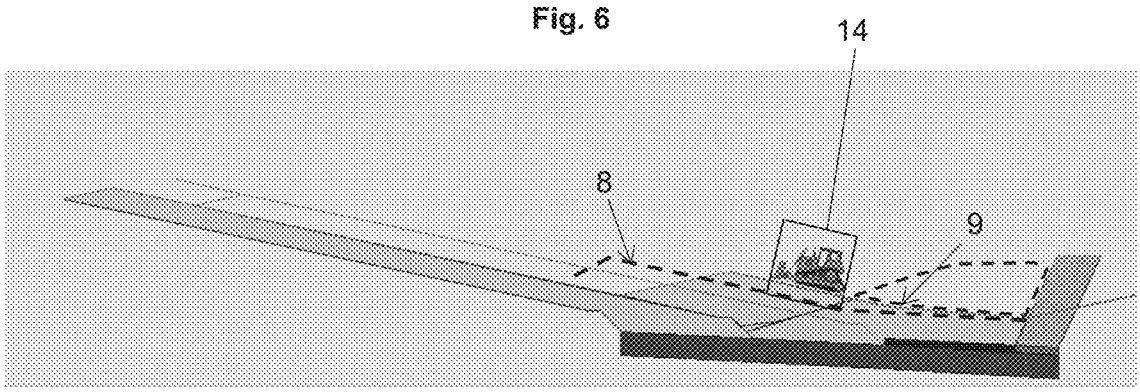
Figure 7:
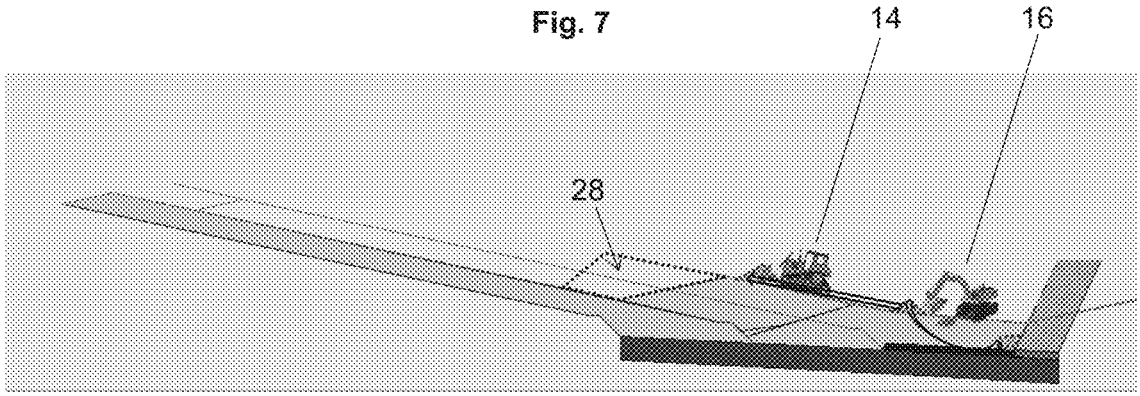
Figure 8:
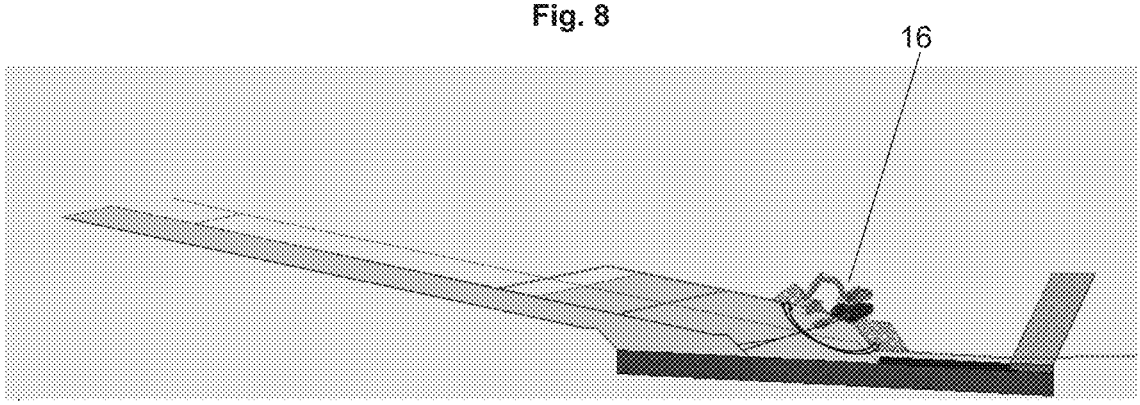
Figure 9:
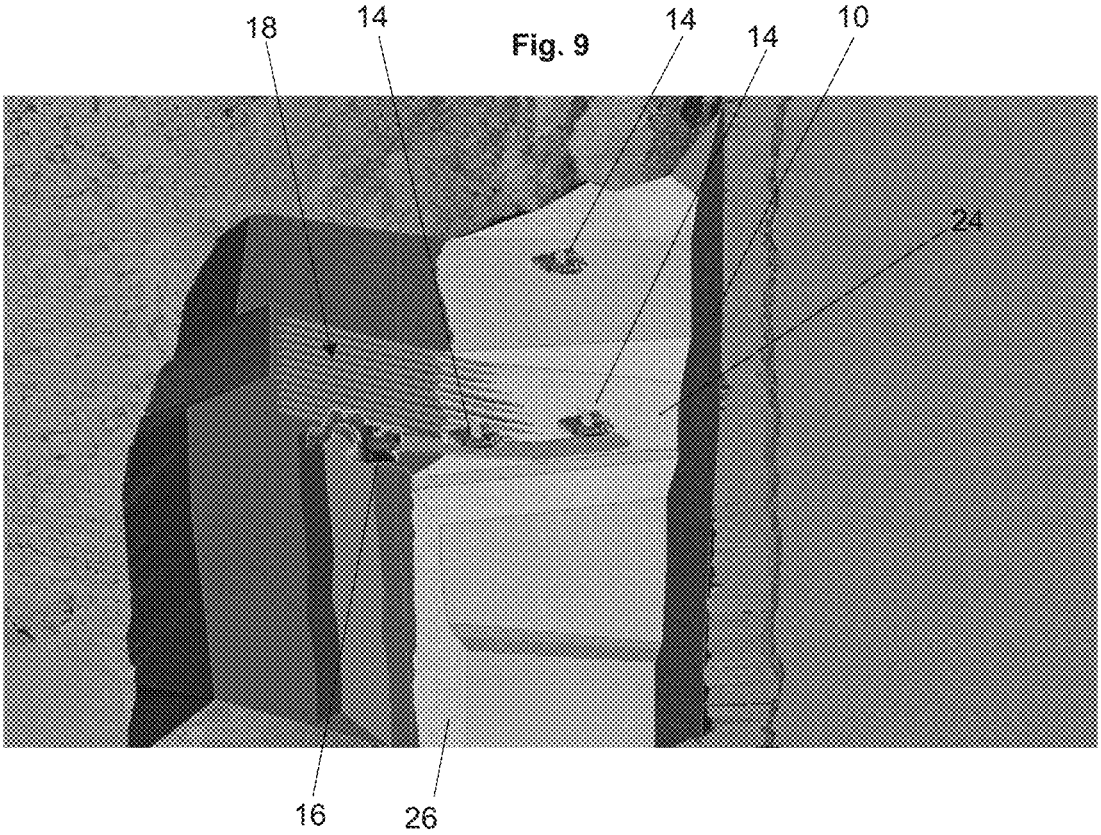
FIGS. 9 to 13 diagrammatically show the dig sequence of post dozing method.
Figure 10:
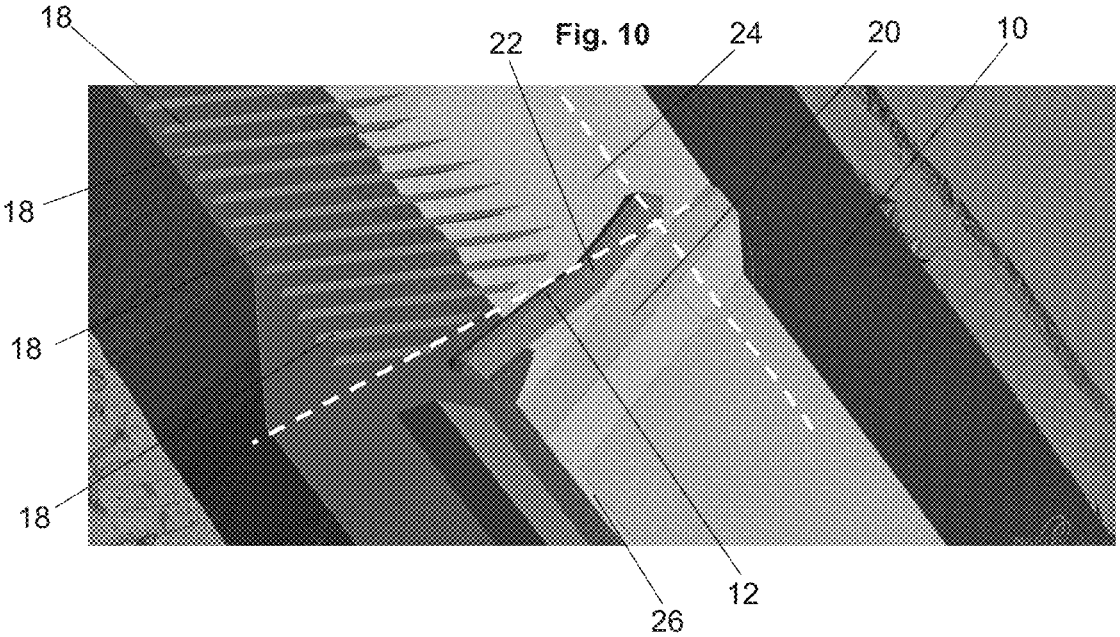

The excavator face orientation is inclined away from perpendicular to the high wall 10 (see FIGS. 9 and 10). The face inclination angle 12 is important to the working of the method. The range of face angles can vary between 10 and 80 degrees but preferably is 45 degrees inclined to the perpendicular from the high wall 10. Furthermore there can be a combination of various angles and a non-linear face. The increasing inclination of the face angle increases the amount of material that the excavator 16 can stockpile 22 for the dozers 14 and allows dozers 14 to push that material into a number of dozer slots 18 which enables more than one dozer 14 to be used simultaneously.

The slope of final dozer surface 24 is calculated to be less than or equal to the maximum economic push grade for dozers 14 based on spoil fit. The slope of the excavator bench 20 is less than that of the final dozer surface 24 and will be the maximum of the maximum excavator working grade and dip of the seam being uncovered. The final dozer surface 24 coincides with the level of the excavator bench 20 at the high wall 10 to allow vehicles and the excavator 16 to access the excavator bench 20. The dozer final surface 24 diverges in level from the excavator bench 20 toward the low wall 26.

The excavator 16 is used to scale the high wall 10 and pull material away from the high wall 10 which is subsequently pushed to final spoil by the dozers 14 (see FIG. 10).

The excavator 16 starts the post dozing dig sequence on the high wall side. Material is dug from the excavator bench 20 on the high wall side and spoiled in a berm along the dozer final surface. Material is dug on the high wall side and placed on the low wall side of the excavator 16 to decrease the dozer push distance. Material is placed into a bund up to a height not exceeding the level of the floor of the cab of the excavator 16 and the bonnet height of the dozer immediately adjacent to the bund so that both the dozer and excavator operators can always see each other's machines on the other side of the bund. A smaller safety bund is maintained along the advancing face of the excavator bench 20 such that vehicles cannot accidently drive over an unprotected edge. The excavator 16 trams along the excavator bench 20 progressively taking a slice of enough material to build the bund from working from the high wall side to the low wall side. While the excavator 16 is working on the high wall side, dozers 14 are pushing the remaining material from the previous bund on the low wall side to final spoil.

Figure 11:
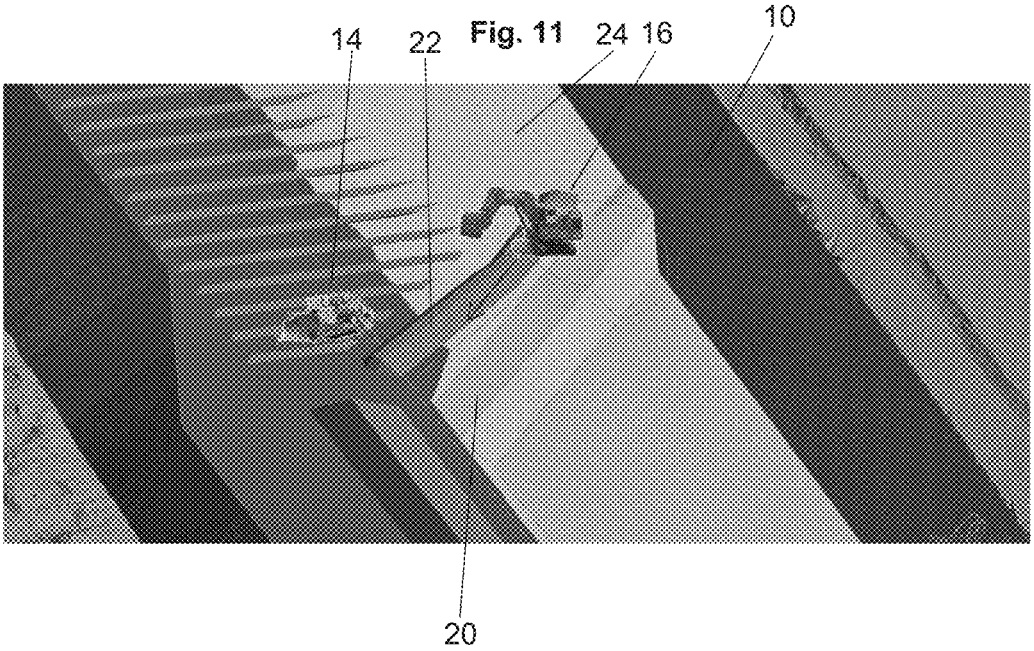

After the dozers 14 finish pushing the previous bund to spoil and the excavator 16 has advanced sufficiently to make material available to the dozers 14 in the new bund, the dozers 14 commencing taking material from the high wall side and pushing it along the existing slots to final spoil (see FIG. 11). The dozers 14 can carry material from the bund into the closest slot. Due to the angle of the dig face, at any time there may be several dozer slots that can be used which allows the option of using multiple dozers 14 simultaneously. The direction of the slots for both the upper dozer material and the post doze material are calculated to satisfy the spoil fit and minimise overall cost and may be perpendicular to the high wall 10 or at an incline to perpendicular to the high wall 10. The direction of the slots may be adjusted to migrate material along the pit to improve the overall cost of stripping the pit and to maximise spoil fit. The direction of the slots is displayed on the GPS guidance system on the dozers 14 (if fitted). The direction of the slots is displayed as push direction arrows.

The dozers 14 are not permitted to operate within the swing radius of the excavator 16 for safety reasons unless given clearance to do so using positive communications, in line with common existing mine site rules. It is anticipated that the dozer should never need to enter the excavator's swing radius under normal operations.

Figure 12:
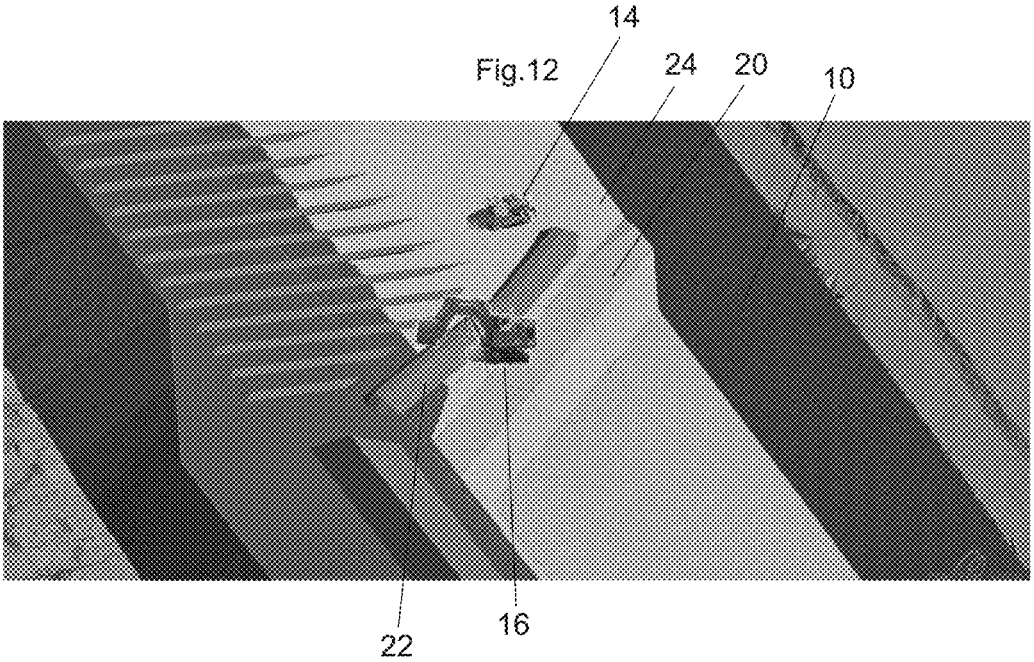

The excavator 16 continues working along the excavator bench 20 towards the low wall 26, taking material from both above and below the excavator bench 20 to maintain the excavator bench 20 grade and width (see FIG. 12). The dozers 14 continue to follow the excavator 16 pushing material from the bund to final spoil along the slot while staying clear of the excavator swing radius.

Figure 13:
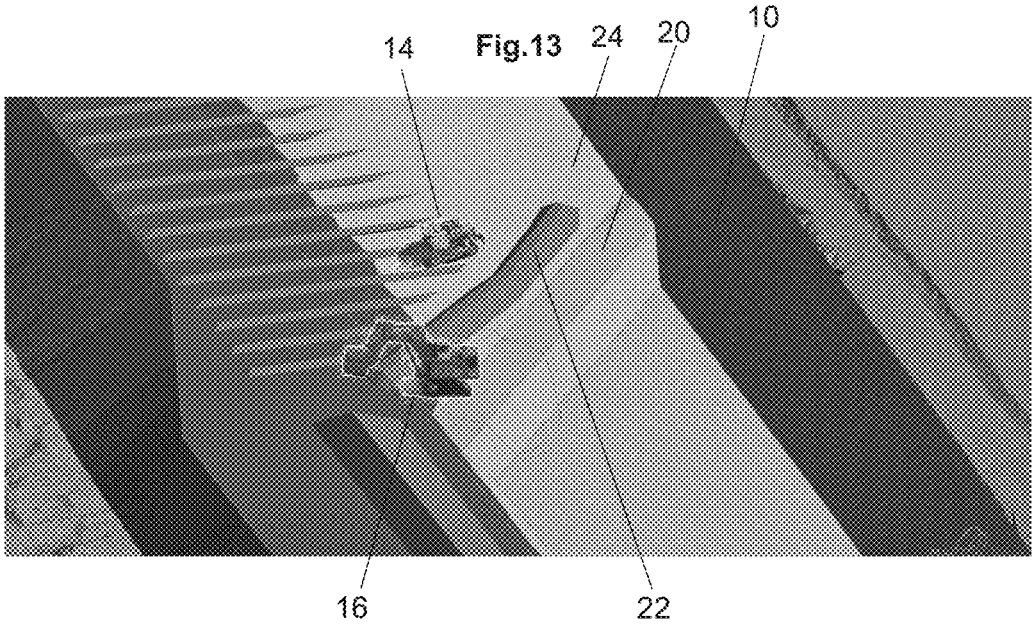

When the excavator 16 reaches the low wall side of the bench, it commences building a ramp up to the low wall 26 by digging material from below the excavator bench 20 and placing it on the excavator bench 20 against the low wall 26 (see FIG. 13). The excavator 16 walks up the ramp onto the low wall 26. The excavator 16 then digs out material from the ramp and from the bund and throws it to final spoil on the low wall 26. The excavator 16 leaves enough width on the ramp to still use the ramp to walk back down to the bench.

Figure 14:
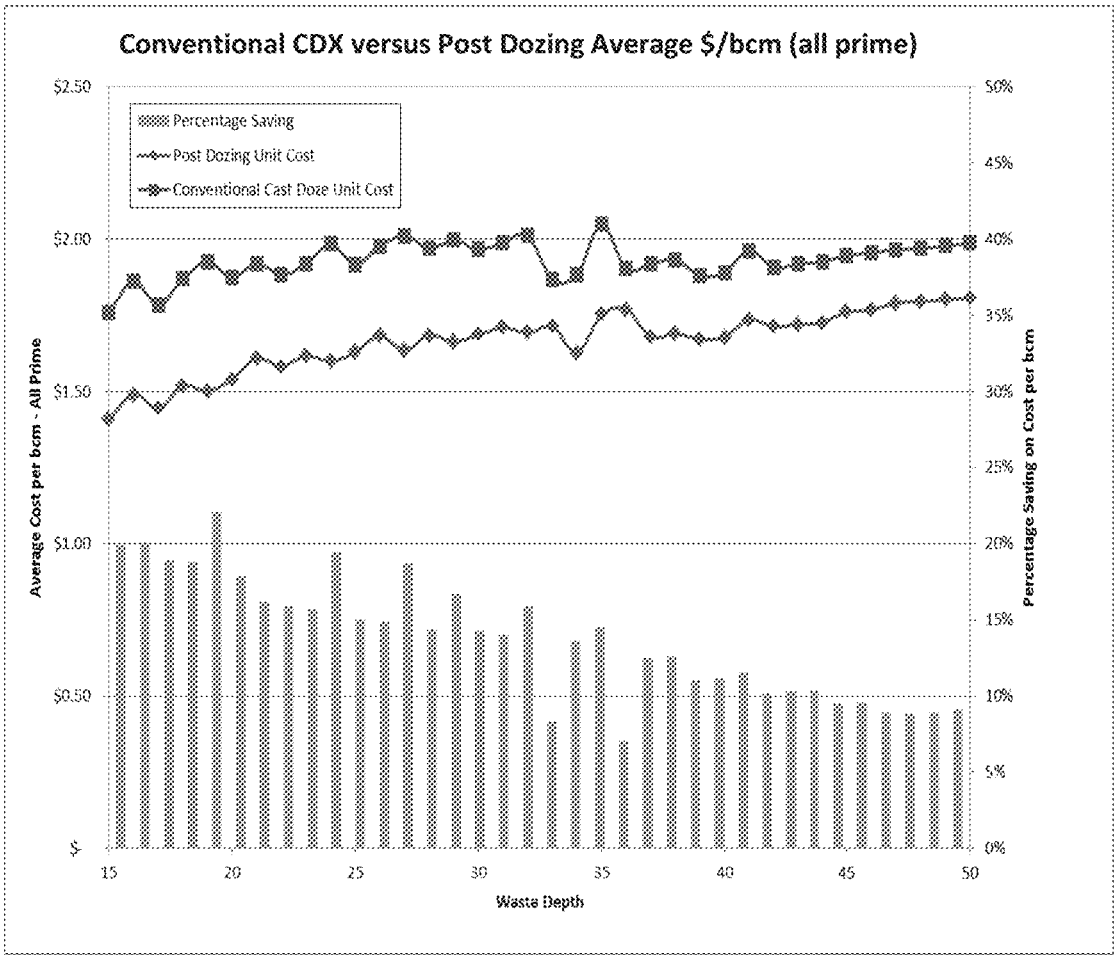
FIG. 14 is a chart showing average cost of bcm with respect to waste depth for the conventional method and the post dozing method.

An analysis was undertaken on a 50 m wide strip uncovering a single coal seam to determine the unit cost savings that may be attained by using the post dozing method. FIG. 14 shows the unit cost of moving the lowest waste burden using both a conventional CDX method and post dozing method for varying waste thicknesses. Reducing the strip width results in further savings being attained using the Post Dozing method.

In the post dozing method, strip widths that are narrower than is considered normal practice would increase dozer productivity in bulk push for both the upper push material and the post doze material.

Conventional cast doze/excavate operations rely on running trucks at the bottom of the excavation to remove the final layer of waste. In order to operate the trucks efficiently, strip widths of 55 m to 65 m are commonly used. The wider strips allow the trucks to complete a U-turn at the bottom of the pit without entering the standoff exclusion zone for the high wall 10 and low wall 26. Typically, it is considered high risk to operate equipment when the operators cab is within 10 m of a high wall 10 or a steep low wall 26. The turning circle of trucks that are commonly used for post strip operations is approximately 35 m, so in order to turn the truck in one motion without entering the exclusion zones, the strip width must be 55 m or more. In a conventional cast/doze/excavate operation, narrowing the strips would decrease the cost of the dozer but increase the cost of the truck shovel, providing no net cost benefit while introducing a safety risk. The post dozing method solves this problem by removing trucks from the waste removal process. Trucks are still required to remove the coal. The coal mining truck productivity may be affected at narrow strip widths. The selection of the best strip width for post dozing depends on the stripping geometry and forms part of the invention.

Using a reduced strip width has a cost saving benefits where pre-strip material is being removed from above the cast/doze/excavate. The reduction in strip width reduces the inventory build that is required for pre-strip particularly where rope shovels are being used in a double strip width configuration.

Example 1: Open Cut Coal Mine with Pit A and Pit B

A preferred embodiment will now be described with reference to a mine plan for removing one strip of waste to uncover one strip of coal in an open cut coal mine. The mine has two pits.

In Pit A, there is a single seam of coal. It takes 4 months to complete one strip in Pit A and one year to complete 3 strips.

In Pit B, there are two vertically stacked seams of coal. It takes 4 months to complete one strip in Pit B and one year to complete 3 strips.

Pit A—Single Coal Seam

A coal mine mines a single 4 m thick seam of coal from Pit A. The seam dips at 4 degrees. The overburden above the seam of coal is 35 m thick at the high wall 10. The mine uses a strip mining method to uncover the coal. A void exists with a width of 50 m where the waste and coal was removed from the previous strip.

The mine uses a combination of cast blasting, bulk dozer push and truck/excavator methods to remove the waste material using a strip mining method. The coal is mined using truck/excavator method and the coal is hauled to the wash plant where it is upgraded, then loaded onto a train for transport to market.

The coal is uncovered in strips. The strip dimension is 50 m wide, 35 m deep and 1000 m long parallel to the previous high wall 10. Strips have a waste volume of 1,750,000 bank metres cubed (bcm). There are 300,000 tonnes of coal underneath the waste in each strip. The mine completes 3 strips each year to uncover a total of 900,000 tonnes of coal per annum.

The equipment that the mine uses in Pit A is 3×Cat D11 dozers that are fitted with standard Cat U blades and an Hitachi EX1900 excavator 16.

The mine has historically used a cast/doze/excavate method to date to move the waste. Blasting costs $1 per cubic metre. When using the cast/doze/excavate method, dozer push costs an average of $2.42 per bank cubic metre (bcm) and dozer push at an average grade of 9% uphill and the average push distance is 105 m. The average dozer push productivity is 205 prime bcm per hr. Truck/excavator waste movement costs an average of $3.50 per bcm. On average 25% of waste material is moved to final spoil by blast cast, 53% by dozer push and 22% by truck/excavator. The total weighted average cost to move all of the waste in one strip including blasting is $3.05 per bcm.

The mine decides to change the stripping method to post dozing, replacing the truck/excavator operation with an excavator/dozer operation.

The waste rock is hard and requires blasting. Blast holes are drilled in the strip. The holes are loaded with explosive. The explosive is initiated, breaking up the rock and throwing 25% of the waste material, being 437,500 bcm per strip into the open void where the material from the previous strip was removed. The low wall angle is 53 degrees from the seam floor at the edge of coal.

Figures 15, 16:
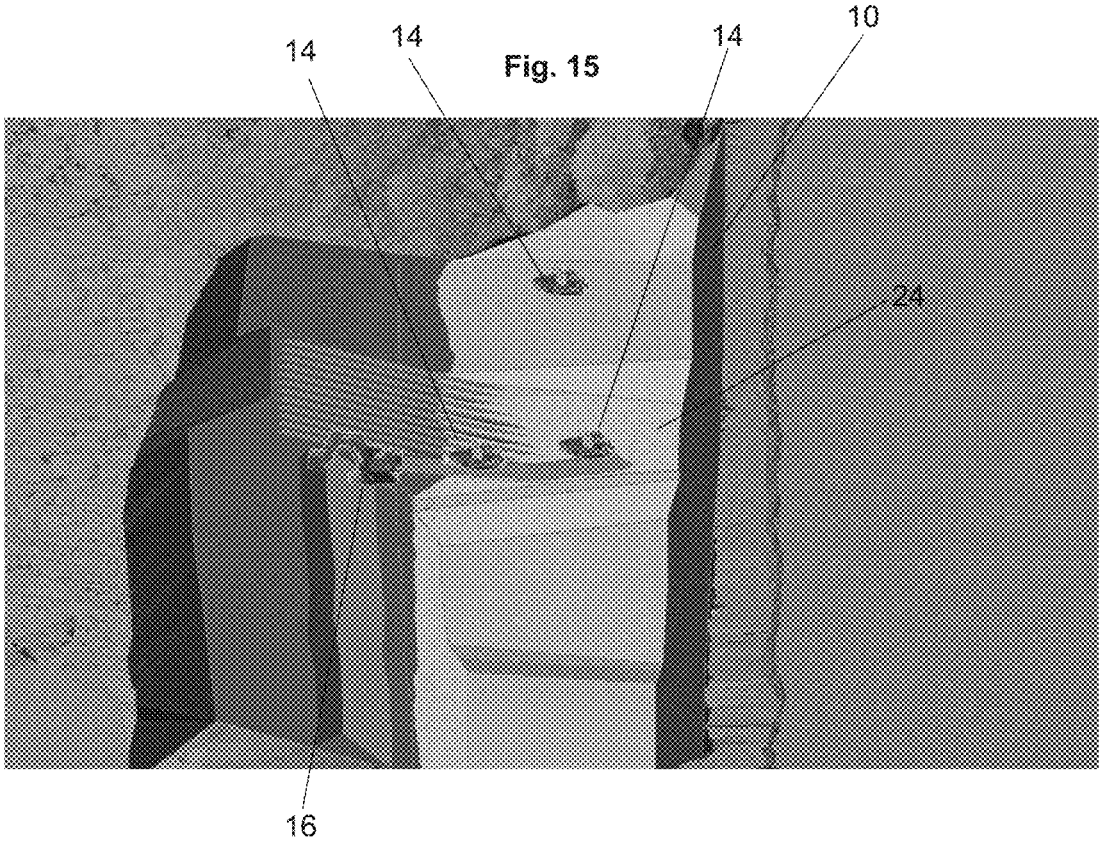
FIG. 15 is a diagrammatic figure showing the post dozing method working in Pit A of example 1.
FIG. 16 is a table showing the cost comparison between CDX versus post dozing method for one whole waste strip (amounts in AUD) in Pit A of example 1.

Cat D11 dozers 14 push waste material starting on the top of the blast profile, filling the blade with spoil from above the coal (right side of the strip in FIG. 15) and pushing it to final spoil (left side of strip in FIG. 15). The Cat D11 dozers 14 continue pushing until material is removed down to the post dozing design surface, moving a total of 783,009 bcm for the whole strip being 44.7% of all prime waste movement. The average grade of the push is 9.0% uphill and the average distance is 95 m. The dozer achieves an average productivity of 230 bcm moved per hour and the average dozer cost is $2.16 per bcm moved by the dozer.

An excavator bench 20 is established adjacent to the post dozing surface at a grade of 4 degrees and along a direction that is inclined at 45 degrees to the orientation of the high wall 10. The excavator bench 20 has a width of 8 m and a depth of 8 m. The Hitachi EX1900 is positioned on the excavator bench 20. The excavator 16 digs waste material both from the excavator bench 20 below the machine and from above the excavator 16 where the post dozing surface is above the excavator bench 20. The Hitachi EX1900 loads the bucket facing toward the high wall 10 and swings material around towards the low wall 26 and lifts the waste material, placing it on the post dozing surface. The dozer pushes the material to spoil. The excavator 16 handles 34% of the waste prime material at a cost of $0.70 per bcm for a total of 592,244 bcm of which 4% of the total prime or 73,231 bcm is cast directly to spoil by the excavator 16. The Cat D11 dozers 14 push 466,737 bcm of material that has been handled by the excavator spoil which is comprised of 456,260 bcm of prime and 10,477 bcm of rehandle (previously pushed by the dozer but not taken to final spoil). The average push distance for the post dozing material is 75 m and the average grade is 16%. The average productivity is 244 bcm per hour at the average cost is $2.05 per bcm. The dozer productivity is assisted by the action of the excavator 16 which loosens the material and shortens the pushes by swinging material towards the spoil. On average, two Cat D11 dozers 14 work in sequence with the excavator 16 pushing stockpiled material to final spoil.

The coal is progressively uncovered as the equipment advances along the strip. There is no truck/excavator material movement required on waste. The coal is mined using truck/excavator and hauled to the wash plant for processing and it is then loaded onto trains for transport to market.

The average cost of moving all waste in Pit A using the post dozing method is $2.75 per bcm for all waste material in a single strip which compares favourably with costs of $3.05 per bcm for all waste with the previously used CDX (cast/doze/excavate) method. The use of the post dozing method in Pit A saves a total of AUD $529,369 per strip and a total of AUD $1,588,106 per annum in waste stripping costs in Pit A compared to the baseline CDX method (see FIG. 16).

Figure 17:
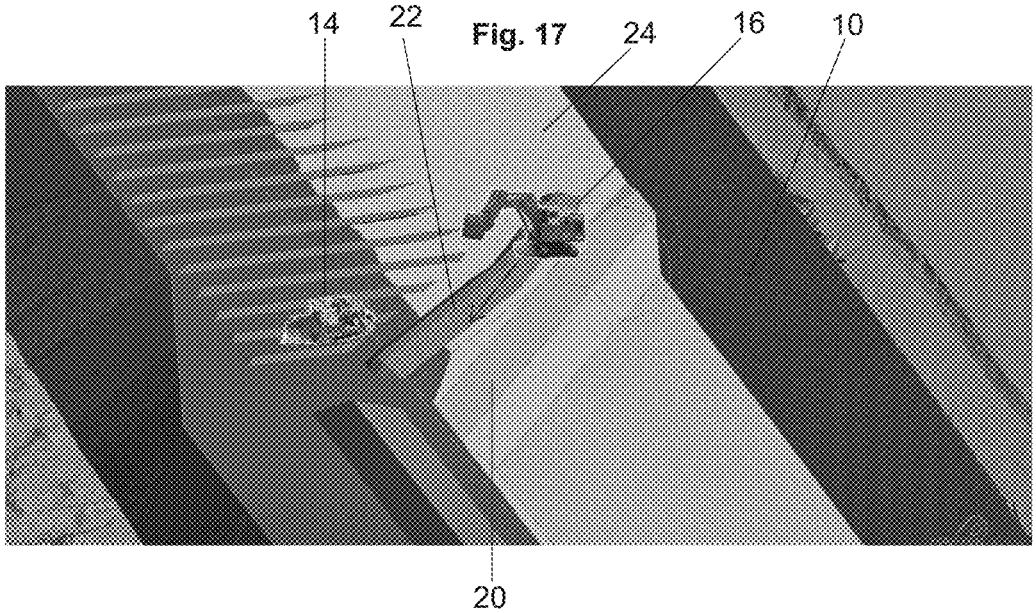
FIGS. 17 to 19 diagrammatically shows the dig sequence operation of the post dozing method in Pit A.
Figure 18:
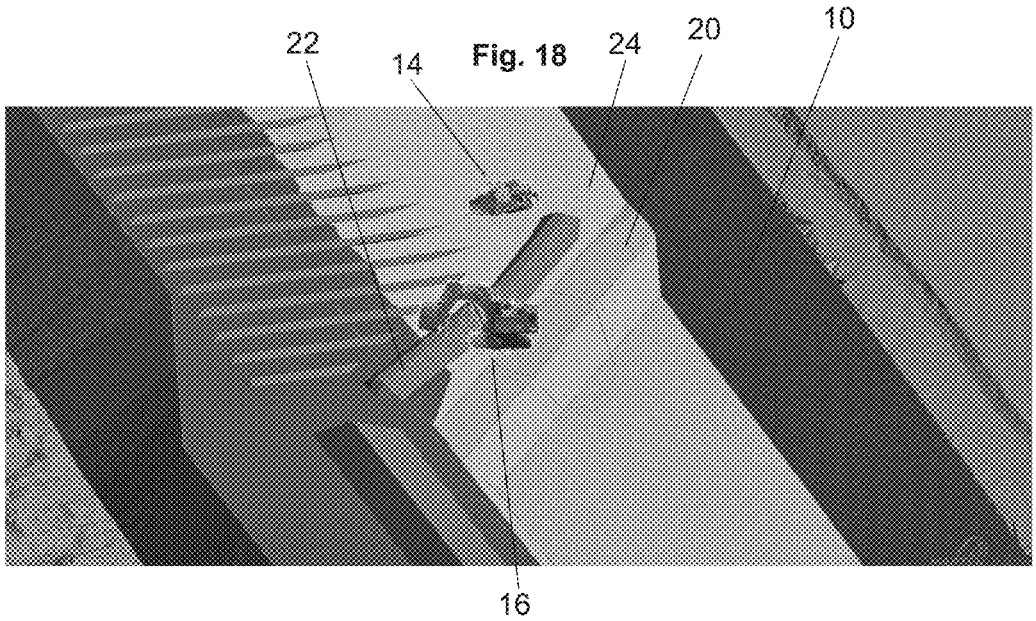
Figure 19:
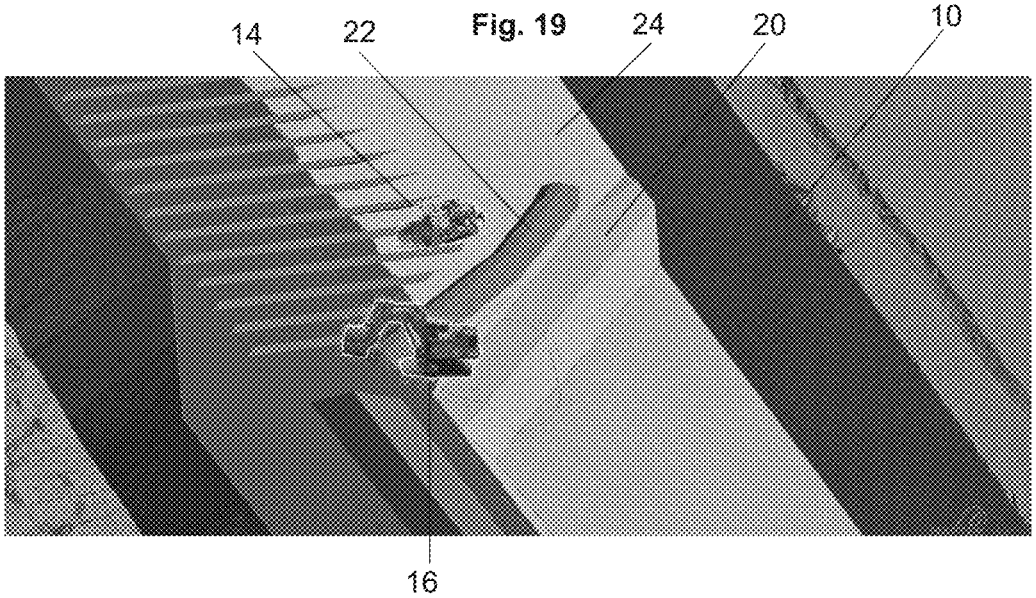
Figure 20:
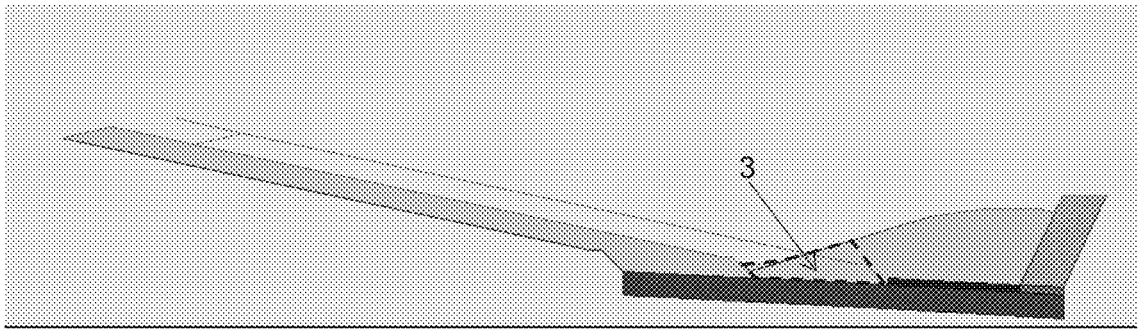
FIGS. 20 to 23 show diagrammatic sectional views of the dig sequence of the post dozing method in Pit A.
Figure 21:
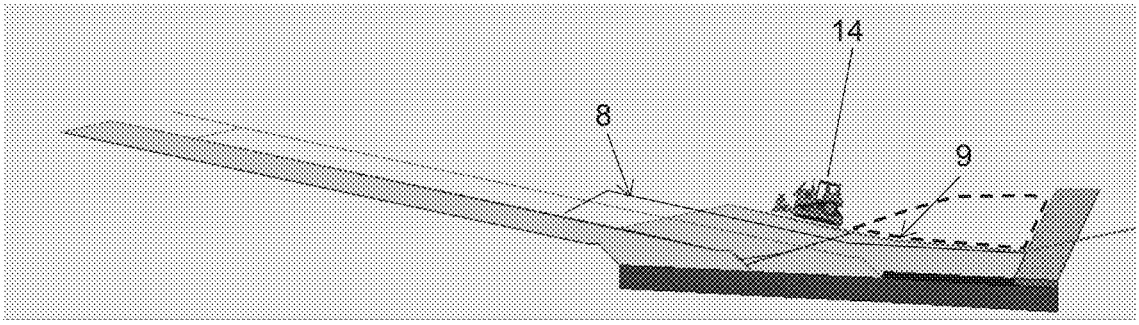
Figure 22:
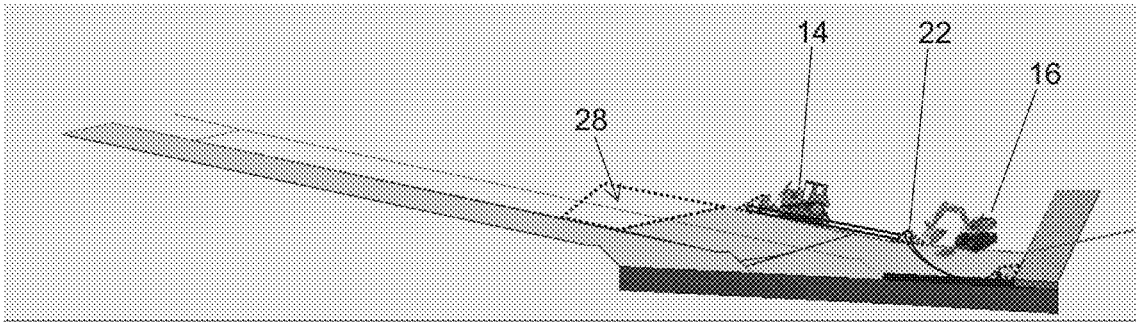
Figure 23:
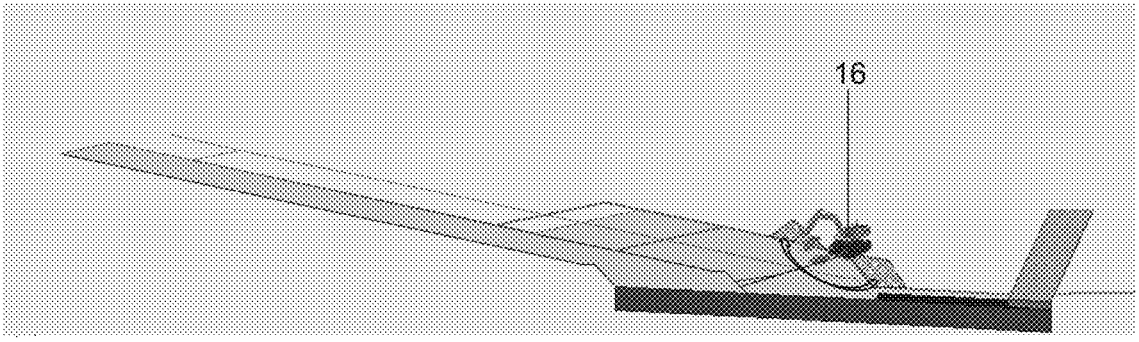
Figure 24:
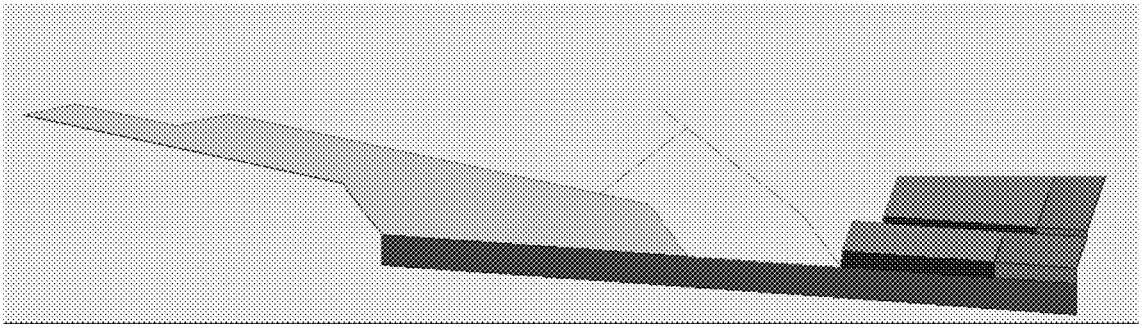
FIGS. 24 to 29 diagrammatically show the dig sequence for the post dozing mining method in Pit B.
Figure 25:
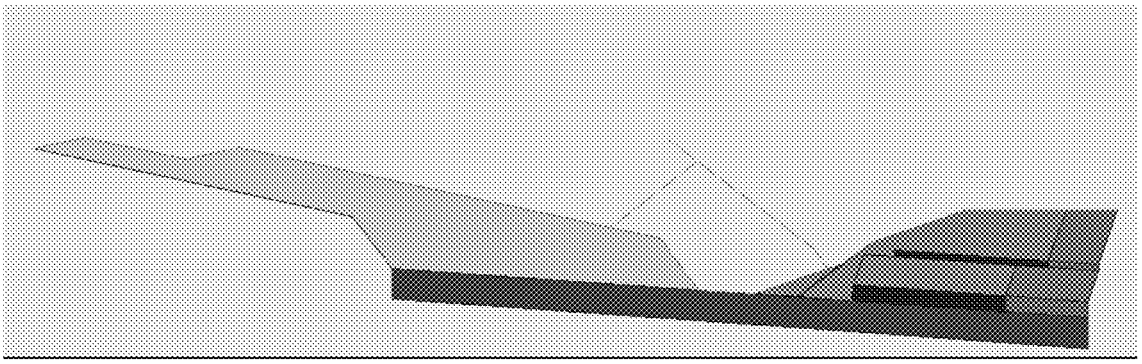
Figure 26:
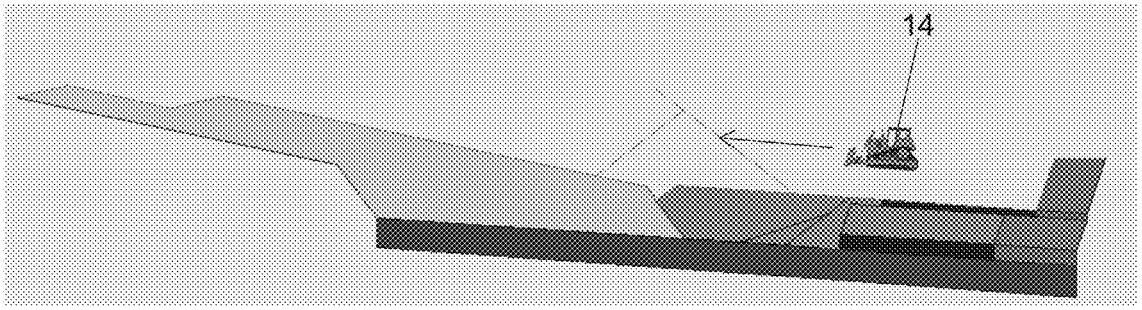
Figure 27:
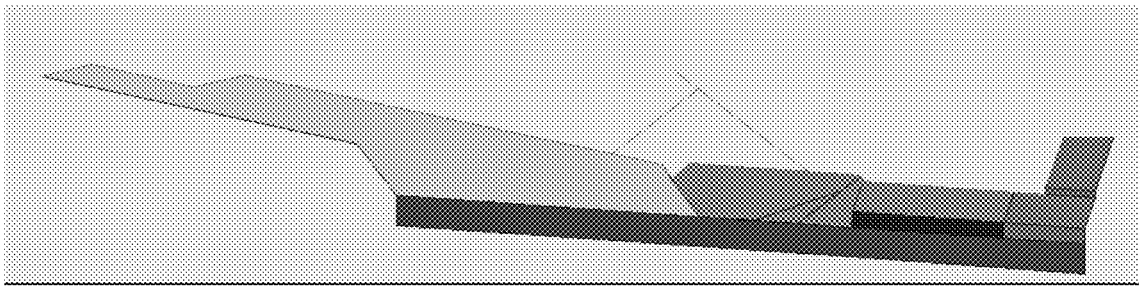
Figure 28:
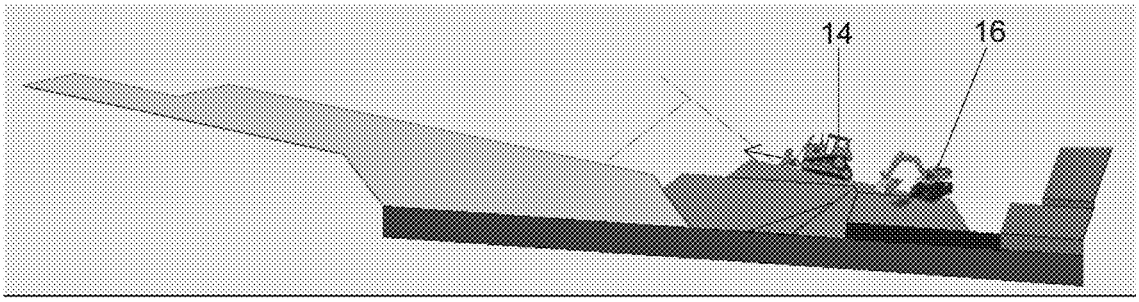
Figure 29:
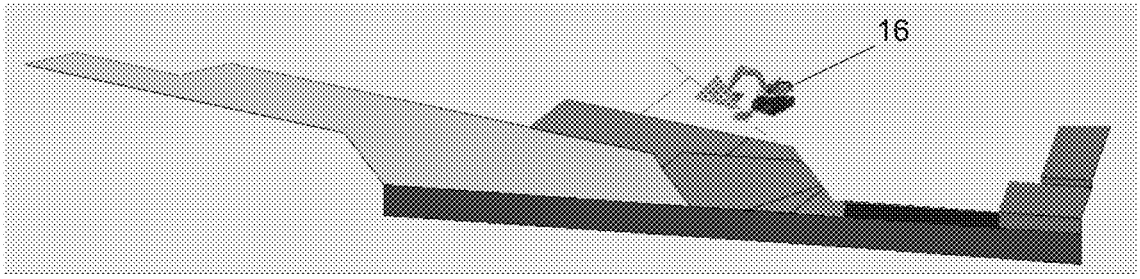

The dig sequence operation of the post dozing method in Pit A is shown in FIGS. 17 to 19. The excavator 16 starts the post dozing dig sequence on the high wall side. Material is dug from the excavator bench 20 on the high wall side and spoiled in a berm along the dozer final surface. Material is dug on the high wall side and placed on the low wall side of the excavator 16 to decrease the dozer push distance. Material is placed into a bund up to a height not exceeding the level of the floor of the cab of the excavator 16 and the bonnet height of the dozer immediately adjacent to the bund such that both the dozer and excavator operators can always see machines on the other side of the bund within the swing radius of the excavator 16. A smaller safety bund is maintained along the advancing face of the excavator bench 20 such that vehicles cannot accidently drive over an unprotected edge. The excavator 16 trams along the excavator bench 20 progressively taking a slice of enough material to build the bund from working from the high wall side to the low wall side. While the excavator 16 is working on the high wall side, dozers 14 are pushing the remaining material from the previous bund on the low wall side to final spoil.

After the dozers 14 finish pushing the previous bund to spoil and the excavator 16 has advanced sufficiently to make material available to the dozers 14 in the new bund, the dozers 14 commencing taking material from the high wall side and pushing it along the existing slots to final spoil. The dozers 14 can carry material from the bund into the closest slot. Due to the angle of the dig face, at any time there may be several dozer slots that can be used which allows the optionality of using multiple dozers 14 simultaneously. The direction of the slots for both the upper dozer material and the post doze material are calculated to satisfy the spoil fit and minimise overall cost and may be perpendicular to the high wall 10 or at an incline to perpendicular to the high wall 10. The direction of the slots is adjusted to migrate material along the pit to improve the overall cost of stripping the pit and to maximise spoil fit. The direction of the slots is displayed on the GPS guidance system on the dozers 14 (if fitted) as push direction arrows.

The dozers 14 are not permitted to operate within the swing radius of the excavator for safety reasons unless given clearance to do so using positive communications, in line with common existing mine site rules. In this sequence, the dozers 14 do not need to enter the excavator's swing radius under normal operations.

The excavator 16 continues working along the excavator bench 20 towards the low wall 26, taking material from both above and below the excavator bench 20 to maintain the excavator bench 20 grade and width. The dozers 14 continue to follow the excavator 16 pushing material from the excavator stockpile to final spoil along the slot while staying clear of the excavator swing radius.

When the excavator 16 reaches the low wall side of the bench, it commences building a ramp up to the low wall 26 by digging material from below the excavator bench 20 and placing it on the excavator bench 20 against the low wall 26. The excavator 16 walks up the ramp onto the low wall 26. The excavator 16 then digs out material from the ramp and from the bund and throws it to final spoil on the low wall 26. The excavator 16 leaves enough width on the ramp to still use the ramp to walk back down to the bench.

FIGS. 20 to 23 show diagrammatic sectional views of the dig sequence of the post dozing method. The post dozing method is demonstrated in these figures using the same geometry as in the example of a conventional cast/doze/excavate method.

A blast casts a portion of the material into final spoil. The dozers 14 push the upper blasted waste material to spoil. The final surface for the dozers 14 is higher than would be the case in a conventional dozer push operation. Less dozer material is taken in this phase of the operation compared to a convention dozer push. The dozer push distances and elevations in post dozing method are reduced compared to a conventional dozer push which leads to an increase in the average dozer push productivity for this material.

After the dozers 14 have moved all of the material above the final dozer profile, the excavator 16 commences side-casting material from below the final dozer profile up onto the final dozer profile. The dozer pushes this material away to final spoil.

The excavator 16 then takes material that sits within its swing radius of the low wall 26 and casts it directly to final spoil. Any material that is left below the reach of the excavator 16 can either be rehandled up by the excavator 16 on the next pass and either dozed to spoil or cast to spoil by the excavator 16.

The post dozing surface is calculated by using sectional analysis in an iterative process to solve for the lowest overall cost by varying the surface level in increments of 1 m. The starting point for the iterations is the CDX dozer economic cut-off surface. The CDX economic cut-off surface is raised in increments of 1 m and the overall cost calculated until the lowest overall cost is found. In each increment, the amount of excavator and dozer material movement is calculated. For bulk dozer push, the average distance and grade of the material is measured in the section and the production rate of the dozer is calculated from the centroid push distance and grade using production curves, grade/traction curves and discount factors that are supplied by Caterpillar in the Cat handbook. The cost of the dozer push material per bcm is calculated by dividing the hourly cost of operating the dozer including maintenance and the operator, by the production rate (in bcm/hr).

Pit B—Two Coal Seams

A coal mine mines one seam of 4 m thickness of coal and a second seam of 2 m thickness of coal. The seams both dip at 4 degrees. The overburden above the lower 4 m seam is 10 m thick. The overburden above the upper 2 m seam is 15 m thick. The mine uses cast blasting and bulk dozer push to uncover the upper seam and truck/excavator to move the waste between the upper seam and the lower seam. A void exists with a width of 50 m where the spoil and coal from the previous strip was removed.

The mine uses a strip mining method in Pit B. The coal is mined using truck/excavator method and the coal is hauled to the wash plant where it is upgraded, then loaded onto a train for transport to market.

The coal is uncovered in strips. The strip dimension is 50 m wide, 25 m deep (total waste depth) and 1000 m long parallel to the previous high wall and strips have a total waste volume of 1,250,000 bank cubic metres (bcm). There are 450,000 tonnes of coal in each strip. The mine completes 3 strips each year to uncover a total of 1,350,000 tonnes of coal per annum from Pit B.

The equipment that the mine uses in Pit B is 3×Cat D11 dozers 14 that are fitted with standard Cat U blades and an Hitachi EX1900 excavator 16.

The mine has historically used a cast/doze/excavate method to date to move the waste. The following describes the cost of the previously used CDX method:

Blasting costs $1 per cubic metre. Dozer push costs an average of $1.07 per bank cubic metre (bcm). Dozer material is pushed at an average grade of 5% downhill and the average push distance is 65 m. The average dozer push productivity is 465 prime bcm/hr. Truck/excavator waste movement costs an average of $3.50 per bcm. On average for the strip, 10% of prime waste material is moved to final spoil by blast cast, 50% by dozer push and 40% by truck/excavator. The total weighted average cost to move all of the waste in one strip including blasting is $3.77 per bcm.

The mine decides to change the stripping method to post dozing method, replacing the truck/excavator operation with an excavator/dozer operation.

FIGS. 24 to 29 show the dig sequence for the post dozing mining method in Pit B. Prior to blasting, the coal has been removed from the previous strip.

The waste material above the upper seam is blasted and 120,000 bcm of material is thrown into the void into final spoil. Blasting costs $1 per bcm across all waste bcms.

The dozers 14 push the blasted waste material above the upper seam into the void, uncovering the coal in the process. The average push distance is 65 m and the average push grade is −5% (downhill). The dozer moves material at a rate of 465 bcm per hr and at a cost of $1.07 per bcm moved.

The upper seam coal is mined using truck/excavator and the coal is hauled to the wash plant to be processed and loaded onto a train for transport to market.

The excavator 16 sits on the bench and digs material from below the tracks, placing it on the dozer level and moving the material from the high wall side to the low wall side with the excavator 16 to the maximum extent possible. The dozers 14 push a total of 796,146 bcm from the second dozer pass (post dozing pass). The average push distance for the post dozing pass is 75 m and the average grade is 16% (uphill). The dozer productivity is 244 bcm per hour and the average dozer cost per bcm for post doze material is $2.05 per bcm. On average, two Cat D11 dozers 14 work in sequence with the excavator 16 pushing stockpiled material to final spoil.

The excavator 16 continues to lift up material and the dozers 14 push the material to spoil. Material that sits against the low wall 26 is placed into final spoil by the excavator 16. Material that is below the reach of the excavator 16 when the excavator 16 is sitting on the low wall 26 is first placed onto the excavator bench 20, then rehandled to final spoil from the low wall 26. The excavator 16 handles a total of 906,847 bcm of waste in one complete strip at an average cost of $0.70 per bcm.

The lower seam coal is then mined using truck/excavator method and hauled to the wash plant for processing before being loaded onto trains for transport to market.

The average cost of moving all waste in Pit B using the post dozing method is $3.48 per bcm for all waste material in a single strip which compares favourably with costs of $3.77 per bcm for all waste with the previously used conventional CDX method. The use of the post dozing method in Pit B saves a total of AUD $358,889 per strip and a total of AUD $1,076,666 per annum in waste stripping costs in Pit B compared to the baseline CDX method (see FIG. 30).

Advantages

The advantages of the preferred embodiment of the present invention include reducing operational costs in removing waste material from covering an ore seam.

The post dozing method replaces high cost truck/shovel post strip with a lower cost post dozing method; requires reduced manning, which flows through to reduced employment overhead costs and supervision; there are a fewer number of machines to buy and maintain; has lower mobilisation costs for dozers than they are for trucks, making it more flexible; has reduced diesel fuel burn; the excavator loosens some dozer push material which would otherwise require dozer ripping, increasing productive dozer time and reducing delays; the full time presence of the large excavator in the pit allows more regular cleaning of the high wall, improving safety for coal mining.

Furthermore the post dozing method enables the waste to be excavated safely and continuously in wet pits that would otherwise have to wait for pumping to completely remove the water and the post dozing method is significantly less affected by wet weather delays than truck shovel operations.

Variations

While the foregoing has been given by way of illustrative example of this invention, all such and other modifications and variations thereto as would be apparent to persons skilled in the art are deemed to fall within the broad scope and ambit of this invention as is herein set forth.

Throughout the description and claims of this specification the word "comprise" and variations of that word such as "comprises" and "comprising", are not intended to exclude other additives, components, integers or steps.

The invention claimed is:

1. A method of moving waste material from a mining site using at least one excavator and a plurality of dozers, including excavating said waste material with the at least one excavator from a dig area, said at least one excavator moving along an excavator path that is parallel with the dig area;

transferring the excavated material to a plurality of slots, each of said slots are positioned at an angle to the excavator path; and pushing the transferred material by one of said plurality of dozers along the slot and away from the excavator path; wherein the excavator path is bordered by a high wall of the dig area and a low wall adjacent the slots, and wherein each slot allows each of the plurality of dozers to move between a proximal position and a distal position relative to the excavator path; said excavator path has a width to form an excavator bench, and wherein the excavator bench is higher near the low wall compared to a section of the excavator bench adjacent the high wall.

2. A method as claimed claim 1, wherein each slot is wide enough for one of said dozers to move along its length.

3. A method as claimed in claim 1, further including the step of depositing the transferred material part way along each of the slots so that the dozers can move to the low wall end of the adjacent slot and then move forward to push the transferred material.

4. A method as claimed in claim 1, wherein the slots are adjacent and parallel with each other.

5. A method as claimed in claim 1, wherein the angle between each of the slots and the path is between 10 and 80 degrees.

6. A method as claimed in claim 1, wherein the angle between each of the slots and the path is substantially 45 degrees.

7. A method as claimed in claim 1, wherein a height difference between a level of the slot and a level of the excavator path is up to 10 meters.

8. A method as claimed in claim 1, wherein a height difference between a level of the slot and a level of the excavator path does not exceed a capacity of the excavator to dig material and transfer it to the slot level.

9. A method as claimed in claim 1, wherein the dozers follow the excavator as it works from the high wall to the low wall.

10. A method as claimed in claim 1, wherein the dozers do not enter a swing radius of the excavator.

11. A method as claimed in claim 1, wherein excavator bench grades and levels are determined so that the excavator and the plurality of dozers have visual contact at all times.

12. A method as claimed in claim 1, wherein a size of the transferred material is limited so that it does not obscure a line of sight between the at least one excavator and the plurality of dozers.

13. A method as claimed in claim 1, further including the step of blasting said waste material prior to excavating the waste material.

14. A method as claimed in claim 1, further including the step of displaying a direction of the slots on GPS guidance systems on the dozers.

15. A method as claimed in claim 14, wherein the direction of the slots are displayed as push direction arrows on the GPS guidance systems.

16. A method as claimed in claim 1, wherein said excavated material is pushed away from the edge of the low wall by the dozers to enable the excavator to transfer further excavated material to the low wall.

* * * * *